US006675970B1

(12) United States Patent
Nemoto

(10) Patent No.: US 6,675,970 B1
(45) Date of Patent: Jan. 13, 2004

(54) CUSHIONING SUPPORT MEMBER AND FABRICATING METHOD THEREOF

(75) Inventor: Eiko Nemoto, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/582,673

(22) PCT Filed: Oct. 29, 1999

(86) PCT No.: PCT/JP99/06006

§ 371 (c)(1),
(2), (4) Date: Oct. 24, 2000

(87) PCT Pub. No.: WO00/26112

PCT Pub. Date: May 11, 2000

(30) Foreign Application Priority Data

Oct. 30, 1998 (JP) ..... 10/311306

(51) Int. Cl.[7] ..... B65D 81/02

(52) U.S. Cl. ..... 206/521; 206/586; 206/590; 206/592; 229/918

(58) Field of Search ..... 206/521, 586, 206/587, 588, 590, 591, 592, 486; 229/918, 191, 195, 179

(56) References Cited

U.S. PATENT DOCUMENTS 3,184,136 A * 5/1965 Forbes, Jr. ..... 206/586
3,211,282 A * 10/1965 Hennessey ..... 206/590
3,226,006 A * 12/1965 Dunn ..... 229/195
3,310,219 A * 3/1967 Dlugopolski ..... 229/117.12
4,056,223 A * 11/1977 Williams ..... 229/160
5,145,070 A * 9/1992 Pallett et al. ..... 206/521
5,285,956 A * 2/1994 Piepho ..... 229/191
5,996,885 A * 12/1999 Chu ..... 229/179

* cited by examiner

*Primary Examiner*—Mickey Yu
*Assistant Examiner*—Jila M. Mohandesi
(74) *Attorney, Agent, or Firm*—Jay H. Maioli

(57) ABSTRACT

A cushioning support member and a fabricating method thereof, in which a container main body can be constituted by using one piece of corrugated cardboard. The container main body can function simultaneously as a cushioning material which produces a cushioning effect for protecting contents from an external force, and the cushioning support member includes a polygonal bottom surface portion, a plurality of side surface portions formed continuously on sides of the bottom surface portion, and a plurality of supporting piece portions formed on at least two side surface portions of the plurality of side surface portions. The bottom surface portion and the plurality of side surface portions and the plurality of supporting piece portions are formed by one corrugated cardboard. The plurality of supporting piece portions and a plurality of supporting column portions which are bent into a cylindrical shape so as to support corner portions of a cubic content, and a plurality of contact portions which contact with side surfaces of the content are formed. Connecting portions between the bottom surface portion and the plurality of side surface portions are bent so that the content is housed and supported.

12 Claims, 10 Drawing Sheets

CUSHIONING SUPPORT MEMBER AND FABRICATING METHOD THEREOF

TECHNICAL FIELD

The present invention relates to a cushioning support member for housing and supporting contents and a fabricating method thereof. In particular, the present invention relates to a cushioning support member which is formed from a single piece of corrugated cardboard and a fabricating method thereof.

BACKGROUND ART

Conventionally, a packaging container used for a comparatively small-sized electronic equipment shown in FIG. 1 is generally known. FIG. 1 is a development of the packaging container 1, and four side surface portions 2*a* through 2*d* which form a square cylindrical main body are connected in a lateral direction via three fold lines 3*a* through 3*c*. A paste margin 2*e* is connected to the outside of the fourth side surface portion 2*d* via a fourth fold line 3*d*.

A first connecting portion 4*a* is connected to the lower side of the side surface portion 2*a* via a fifth fold line 3*e*, and a first bottom portion 5*a* is connected to the lower side of the side surface portion 2*b* via a sixth fold line 3*f*. Moreover, a second connecting portion 4*b* is connected to the lower side of the side surface portion 2*c* via a seventh fold line 3*g*, and a second bottom portion 5*b* is connected to the lower side of the side surface portion 2*d* via an eighth fold line 3*h*. A first holding portion 6*a* is connected to the upper side of the side surface portion 2*a* via a ninth fold line 3*i*, a first upper surface portion 7*a* is connected to the upper side of the side surface portion 2*b* via a tenth fold line 3*j*. Moreover, a second holding portion 6*b* is connected to the upper side of the side surface portion 2*c* via an eleventh fold line 3*k*, and a second upper surface portion 7*b* is connected to the upper side of the side surface portion 2*d* via a twelfth fold line 3*l*. Further, a first insertion portion 8*a* is connected to the first upper surface portion 7*a* via a thirteenth fold line 3*m*, and a second insertion portion 8*b* is connected to the second upper surface portion 7*b* via a fourteenth fold line 3*n*.

As for the packaging container 1 constituted in the above manner, the paste margin 2*e* is overlapped with the first side surface portion 2*a* and are sealed by adhesive so that a cylindrical main body which forms a square frame is formed. An end closing portion which closes a lower end of the cylindrical main body is composed of the two bottom surface portions 5*a* and 5*b*. The two bottom surface portions 5*a* and 5*b* have trapezoidal shapes of equal shape and size which become narrower towards their ends. Engagement portions 9*a* and 9*b* for engaging the ends of the bottom surface portions 5*a* and 5*b* with each other so as to make them self-locking are provided respectively at the center portions of the ends.

One edge of the engagement portions 9*a* and 9*b* of the bottom surface portions 5*a* and 5*b* is a circular convex portion, and the other edge is an inclined portion with an angle of about 45°. First and second coupling portions 11*a* and 11*b* are provided via first and second hollow fold lines 10*a* and 10*b* which extend slantingly from the bottoms of the inclined portions towards the directions of the first and third fold lines 3*a* and 3*c*. The coupling portions 11*a* and 11*b* are overlapped with the first and second connecting portions 4*a* and 4*b* respectively so as to be sealed by adhesive. As a result, the first connecting portion 4*a* is jointed to the first bottom portion 5*a*, and the second connecting portion 4*b* is jointed to the second bottom surface portion 5*b*. Meanwhile, the engagement portion 9*a* of the bottom surface portion 5*a* is engaged with the engagement portion 9*b* of the other bottom surface portion 5*b* so that the bottom surface which is the self-locking type end closing portion is formed.

As a packaging cushioning material which is used for the packaging container 1, a cushioning material made of plastic foam such as styrene foam or obtained by pulp molding is generally used. However, as the cushioning material using a corrugated cardboard, a cushioning material shown in FIGS. 2 and 3 is known, for example. The cushioning material 12 made of corrugated cardboard has an inside cushioning portion 13 and an outside cushioning portion 14 which are cut out of one piece of corrugated cardboard and are arranged parallel with each other. The cushioning portions 13 and 14 are connected by a connecting portion 15 at their center portions so as to form a united piece of material. The cushioning portions 13 and 14 are bent along first and second fold lines 16*a* and 16*b* which are provided respectively on both sides of the connecting portion 15 so that the inside cushioning portion 13 which is slightly shorter is overlapped on the outside cushioning portion 14.

The inside cushioning portion 13 has a first inside portion 13*a* and a second inside portion 13*b* which are connected via third and fourth fold lines 16*c* and 16*d*, and a third inside portion 13*c* which is connected via a fifth fold line 16*e*. One side of the connecting portion 15 is connected to the second inside portion 13*b* positioned in the center portion. The outside cushioning portion 14 has a first outside portion 14*a* and a second outside portion 14*b* which are connected via sixth and seventh fold lines 16*f* and 16*g* and a third outside portion 14*c* which is connected via eighth and ninth fold lines 16*h* and 16*i*. The other side of the connecting portion 15 is connected to the second outside portion 14*b* positioned at the center portion. An engagement portion 14*d* is connected to the first outside portion 14*a* via a tenth fold line 16*j*, and two fold lines 16*k* and 16*l* are provided to the engagement portion 14*d*.

Furthermore, the first through third inside portions 13*a* through 13*c* of the inside cushioning portion 13 and the first and third outside portions 14*a* and 14*c* of the outside cushioning portion 14 are provided respectively with housing holes 17*a* through 17*e* which form a housing concave portion 17 for housing a content such as electronic equipment. The housing holes 17*a* through 17*e* are formed into shapes according to section shapes in each layer of the content by the order of folding the first through third inside portions 13*a* through 13*c* and the first and third outside portions 14*a* and 14*c*. The first outside portion 14*a* positioned in the topmost layer is provided with a slip-off preventing portion 18 which covers a portion of a peripheral edge of the content so as to prevent the content from slipping out of the housing concave portion 17, and a through groove 19 through which a strap or the like attached to the content is inserted.

The cushioning material 12 having such a structure is assembled in the following manner. The inside cushioning portion 13 and the outside cushioning portion 14 are folded along first and second fold lines 16*a* and 16*b* so that the inside cushioning portion 13 is overlapped on the outside cushioning portion 14. The third inside portion 13*c* is folded along the fifth fold line 16*e* so as to be overlapped on the second inside portion 13*b*. The first inside portion 13*a* and the second inside portion 13*b* are folded long the third and fourth fold lines 16*c* and 16*d* so that the first inside portion 13*a* is overlapped on the third inside portion 13*c*. The second outside portion 14*b* and the third outside portion 14*c* are folded along the eighth and ninth fold lines 16*h* and 16*i* so that the third outside portion 14*c* is overlapped on the first inside portion 13*a*. Further, the first outside portion 14*a* and the second outside portion 14*b* are folded along the sixth and seventh fold lines 16*f* and 16*g* so that the first outside portion 14*a* is overlapped on the third outside portion 14*c*. The engagement portion 14*d* is folded along the tenth, eleventh and twelfth fold lines 16*j*, 16*k* and 16*l* successively so as to be twined. As a result, as shown in FIG. 3, the corrugated cardboard-made cushioning material 12 having the six-layered structure can be obtained.

However, in the conventional packaging container, the cushioning material 12 (or cushioning material such as styrene foam) is provided separately from the packaging container 1. The cushioning material 12 is housed in the assembled packaging container 1 and the content is wrapped by the cushioning material 12 so as to be protected. For this reason, a great number of parts are used and this is expensive, and a lot of packaging steps are required. Furthermore, the following problem arises.

In the case where the cushioning material made of styrene foam or the like is used, since the cushioning material is generally fabricated by using a die, it takes a lot of time to fabricate the die and the production costs of the die are large. As a result, the production costs of the die is added to the cushioning material, and the cushioning material itself is expensive. Moreover, in the case where the cushioning material made of styrene foam is used, since the recycle system of used cushioning materials is not established, there arises a problem of the disposal of used materials. Therefore, the cushioning material is not preferable from the viewpoint of the environment.

In the case of the cushioning material 12 obtained by assembling the corrugated cardboard, one surface of the housing concave portion 17 to/from which a content is attached/detached is open. For this reason, it is impossible to cover the housed container wholly by only the cushioning material 12 and protect it. Moreover, a substantially large space in the packaging container 1 is filled with the cushioning material 12 except for a content. For this reason, a lot of corrugated cardboard is used and this is expensive and the weight becomes larger. Further, since the cushioning material 12 is mostly stored with it being assembled as shown in FIG. 3, a wide space for the storage is required, and transport costs increase.

The present invention is devised in order to solve the conventional problems. It is an object of the invention to provide a cushioning support member in which a container pattern which is obtained by cutting out of one corrugated cardboard is folded so as to have a cubic shape so that a content can be held securely and if an external force is applied due to dropping, the external force is absorbed by deformation of the container and the content is not damaged.

DISCLOSURE OF THE INVENTION

A cushioning support member of the present invention comprises: a polygonal bottom surface portion; a plurality of side surface portions formed continuously on respective sides of the bottom surface portion; and a plurality of supporting piece portions which are formed on at least two side surface portions of the plurality of side surface portions, wherein the bottom surface portion, the plurality of side surface portions and the plurality of supporting piece portions are formed by one corrugated cardboard, and the plurality of supporting piece portions, a plurality of supporting column portions, which are formed by bending into a cylindrical shape so as to support four corners of a cubic content, and a plurality of contact portions which contact with side surface of the content are formed, and connecting portions with the plurality of side surface portions are bent so as to support the cubic content.

A method of fabricating a cushioning support member according to the present invention, comprises the steps of: forming a base material, which has a polygonal bottom surface portion, a plurality of side surface portions formed continuously on sides of the bottom surface portion, and a plurality of supporting piece portions formed on at least two side surface portions of the plurality of side surface portions, from one corrugated cardboard; forming the plurality of supporting piece portions, a plurality of supporting column portions which are bent into a cylindrical shape so as to support corner portions of a cubic content, and a plurality of contact portions which contact with side surfaces of the content; and bending continuous portions between the bottom surface portion and the plurality of side surface portions into a substantially box shape.

BEST MODE FOR CARRYING OUT THE INVENTION

There will be explained below an embodiment of the present invention with reference to the drawings. FIGS. 4 through 14 show an example where the packaging container of the present invention is applied to a cushioning support member which is used for housing a comparatively small-sized electronic equipment such as a tape recorder or an electronic dictionary as contents.

Figure 1:
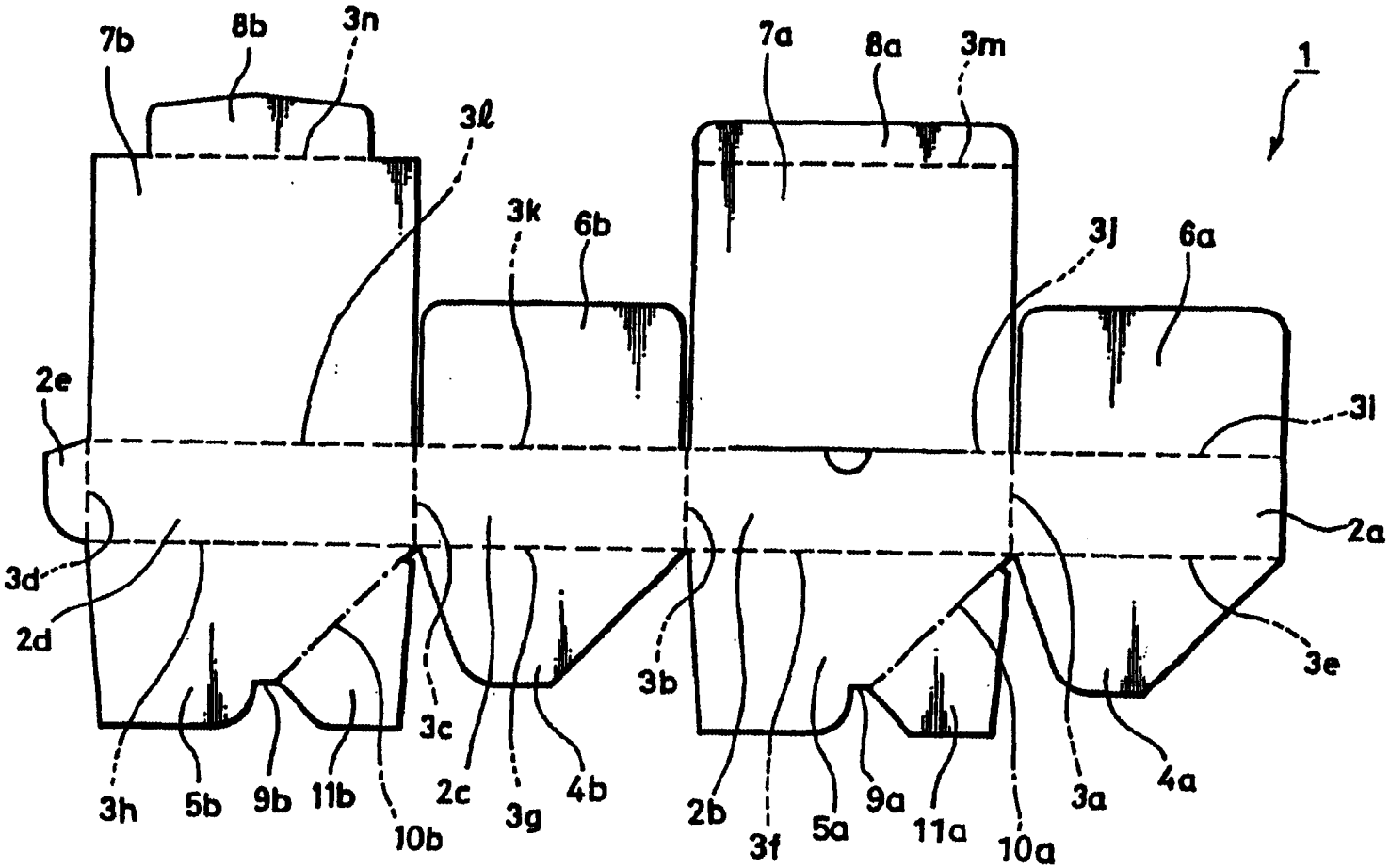
FIG. 1 (PRIOR ART)
FIG. 1 is a development showing a conventional packaging container.
Figure 2:
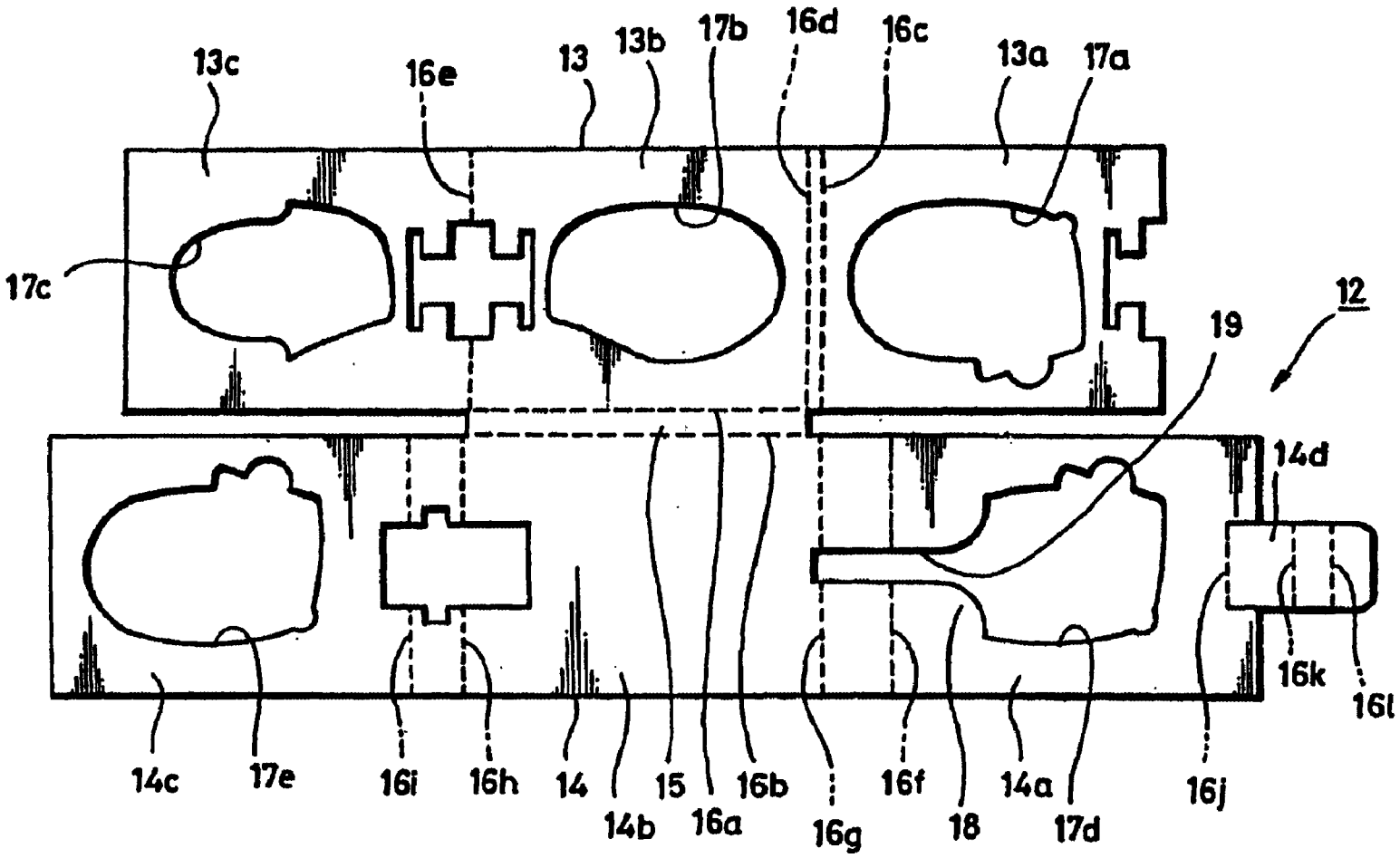
FIG. 2 (PRIOR ART)
FIG. 2 is a development showing a conventional cushioning material.
Figure 3:
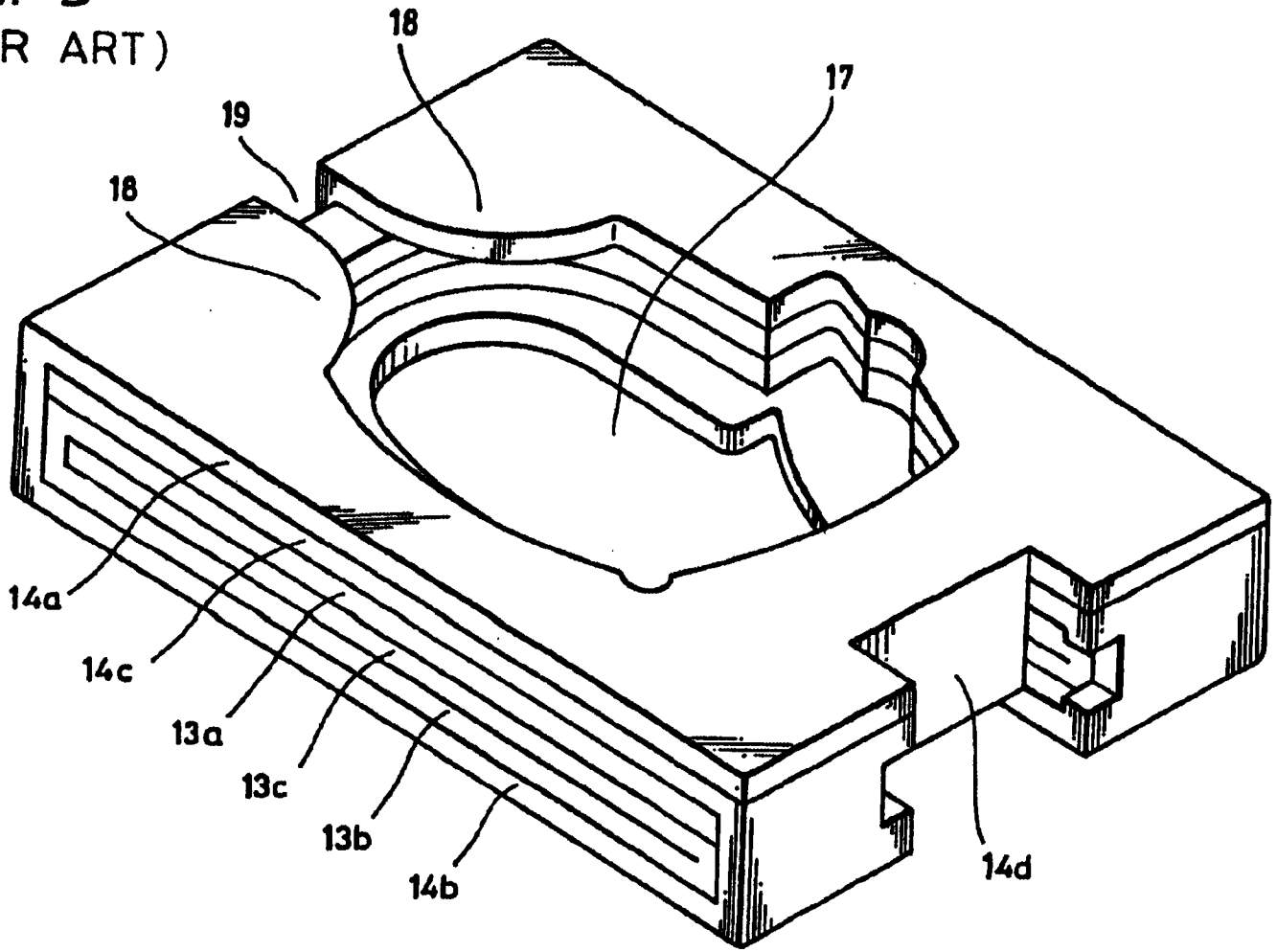
FIG. 3 (PRIOR ART)
FIG. 3 is a perspective view showing an assembled state of the conventional cushioning material.
Figure 4:
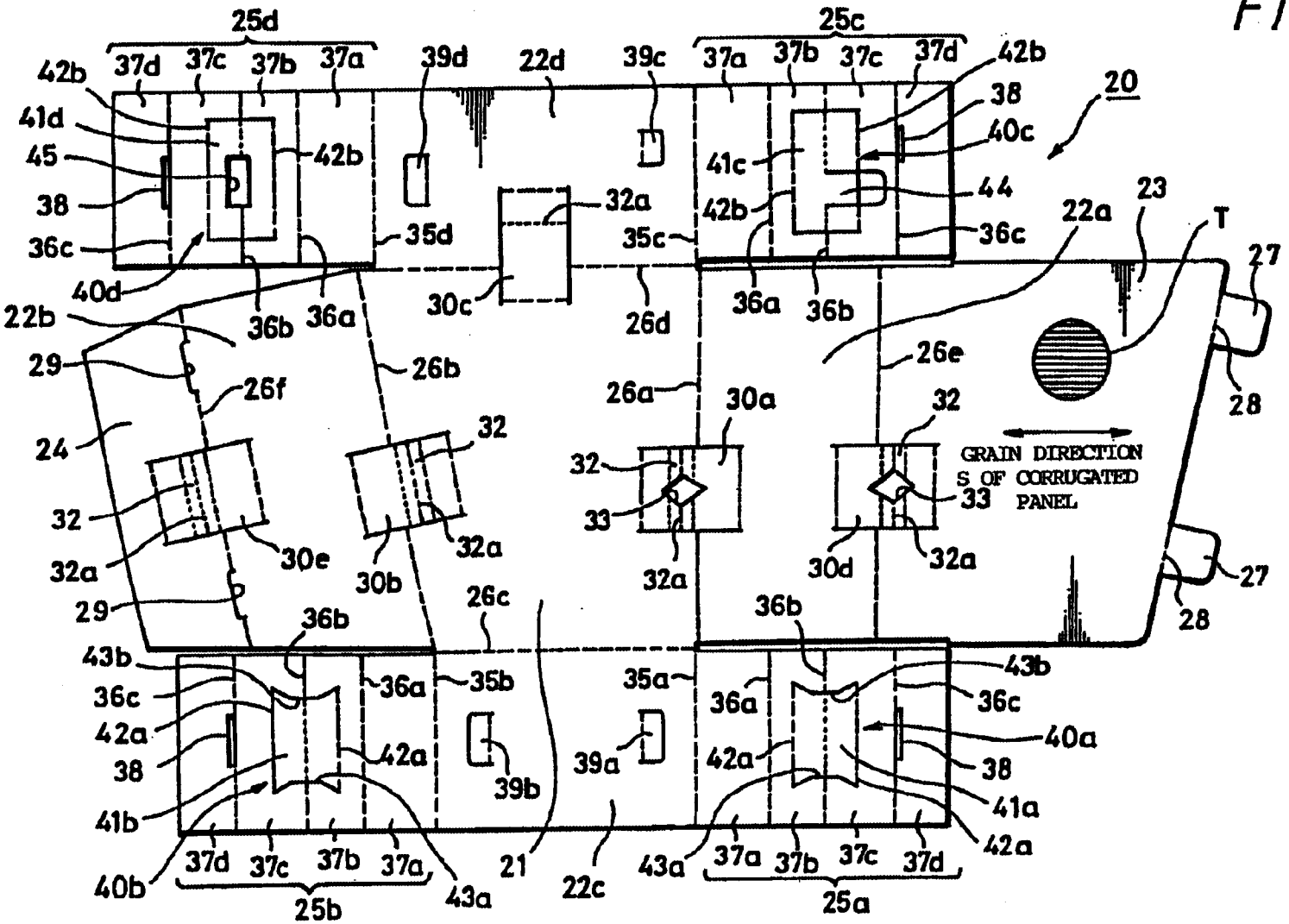
FIG. 4 is a development showing a cushioning support member according to one embodiment of the present invention.

In the development shown in FIG. 4, a bottom surface portion and an upper surface portion are trapezoidal, but since it is difficult to draw a cubic perspective view, FIGS. 5 through 10 show the diagrams that the bottom surface portion and the upper surface portion are changed into a rectangular shape. The cushioning support member of the present invention may be further housed in a packaging container such as a decorative box or may be used in a state that a content is being housed therein, namely, in a state shown in FIGS. 7 and 8, mentioned later.

A base material 20 composing the cushioning support member is fabricated in such a manner that one piece of corrugated cardboard undergoes a blanking process or the like. In FIG. 4, a circular portion represented by a symbol T shows a grain direction S of a corrugated panel of the corrugated cardboard (direction where the top portion and the bottom portion are continued). As shown in FIG. 4, it is preferable to set the grain direction S of the corrugated panel on which another board is stuck to both the surfaces (or one surface), but the direction S may be set to a direction which intersects perpendicularly to the direction shown in FIG. 4. Respective portions of the base material 20 are bent to predetermined directions along fold lines represented by broken lines in FIG. 4 so that the cushioning support member according to the present embodiment, namely, the flat rectangular parallelepiped cushioning support member is assembled cubically.

The base material 20 has a structure shown in the development of FIG. 4. Namely, the base material 20 has a trapezoidal bottom surface portion 21, four side surface portions 22*a*, 22*b*, 22*c* and 22*d* which are connected to four sides of the bottom surface portion 21, an upper surface portion 23 and an overlap portion 24 which is connected to the side surface portions 22*a* through 22*d*, and four supporting piece portions 25*a*, 25*b*, 25*c* and 25*d*.

The bottom surface portion 21 is positioned in a substantially center portion of the base material 20, and the four side surface portions 22*a* through 22*d* are provided to the four sides of the bottom surface portion 21 so as to be projected to four directions. Namely, the first side surface portion 22*a* is connected to one side of the bottom surface portion 21 in the grain direction S of the corrugated panel via a first lateral fold line 26*a*. The second side surface portion 22*b* is connected to one side of the bottom surface portion 21 which is counter to the first lateral fold line 26*a* via a second lateral fold line 26*b*. The third side surface portion 22*c* is connected to one side of the bottom surface portion 21 in a direction which intersects perpendicularly the first lateral fold line 26*a* (direction which intersects perpendicularly the grain direction S of the corrugated panel) via a third lateral fold line 26*c*. The fourth side surface portion 22*d* is connected to one side which is counter to the third lateral fold line 26*c* via a fourth lateral fold line 26*d*.

Furthermore, the upper surface portion 23 is positioned on the outside of the first side surface portion 22*a* in the grain direction S, and the overlap portion 24 is positioned on the outside of the second side surface portion 22*b* in the grain direction S. Namely, the upper surface portion 23 is connected to one side of the first side surface portion 22*a* which is counter to the first lateral fold line 26*a* via a fifth lateral fold line 26*e*. The overlap portion 24 is connected to one side of the second side surface portion 22*b* which is counter to the second lateral fold line 26*b* via a sixth lateral fold line 26*f*. Two flap portions 27 are provided to the end of the upper surface portion 23 with a predetermined interval in a direction which crosses the grain direction S. The flap portions 27 are connected to the upper surface portion 23 via fold lines 28. Two insertion openings 29 are provided in corresponding positions of the sixth lateral fold line 26*f* which overlaps on the end side of the upper surface portion 23. The two insertion openings 29 are formed by providing convex portions with sizes according to the insertion openings 29 to the second side surface portion 22*b*. The overlap portion 24 is bent at 90° along the sixth lateral fold line 26*f* so that the two insertions openings 29 are opened on the convex portions.

First through fifth foldout portions 30*a*, 30*b*, 30*c*, 30*d* and 30*e* having suitable widths in the direction of the fold lines are provided respectively at a connecting portion between the bottom surface portion 21 and the first side surface portion 22*a*, a connecting portion between the bottom surface portion 21 and the second side surface portion 22*b*, a connecting portion between the bottom surface portion 21 and the fourth side surface portion 22*d*, a connecting portion between the first side surface portion 22*a* and the upper surface portion 23 and a connecting portion between the second side surface portion 22*b* and the overlap portion 24. The first foldout portion 30*a* is formed in such a manner that two cuts, which are parallel with each other at a halfway portion of the first lateral fold line 26*a* and enter the bottom surface portion 21 and the first side surface portion 22*a* to a predetermined depth, are made. The first foldout portion 30*a* is folded inward so that a first lower surface supporting portion 21*a*, which supports one side of the bottom surface of the housed content other than corner portions from below, is formed.

The second foldout portion 30*b* is formed in such a manner that two cuts, which are parallel with each other at a halfway portion of the second lateral fold line 26*b* and enter the bottom surface portion 21 and the second side surface portion 22*b* to a predetermined depth, are made. The second foldout portion 30*b* is folded inward so that a second lower surface supporting portion 21*b*, which supports a side of the bottom surface of the content other than the corner portions which is counter to the above-mentioned side from below, is formed. The third foldout portion 30*c* is formed in such a manner that two cuts, which are parallel with each other in a halfway portion of the fourth lateral fold line 26*d* and enter the bottom surface portion 21 and the fourth side surface portion 22*d* to a predetermined depth, are made. The third foldout portion 30*c* is folded inward so that a side surface supporting portion 21*c*, which supports a side surface of the content other than the corner portions in a direction intersecting perpendicularly the above side from sideways, is formed.

Further, the fourth foldout portion 30*d* is formed in such a manner that two cuts, which are parallel with each other in a halfway portion of the fifth lateral fold line 26*e* and enter the first side surface portion 22*a* and the upper surface portion 23 to a predetermined depth, are made. The fourth foldout portion 30*d* is folded inward so that a first upper surface supporting portion 21*d* which presses and supports one side of the upper surface of the content other than the corner portions from above, is formed. The fifth foldout portion 30*e* is formed in such a manner that two cuts, which are parallel with each other in a halfway portion of the sixth lateral fold line 26*f* and enter the second side surface portion 22*b* and the overlap portion 24 to a predetermined depth, are made. The fifth foldout portion 30*e* is folded inward so that a second upper surface supporting portion 21*e*, which presses and supports a side of the content other than the corner portions which is counter to the above side from above, is formed.

Curved portions 32 which are elastically deformed by application of a predetermined or more external force so as to absorb the impact force are provided respectively to corners of the four supporting portions 21*a*, 21*b*, 21*d* and 21*e* which support the content housed and supported in the cushioning support member from up and down directions (vicinities of fold lines 32*a* set in halfway portions of the cut lines). The curved portions 32 may have a structure which is elastically deformed by an external force to be applied so as to absorb the impact force, and more concretely one or not less than two inclined surfaces or curved surfaces are provided to corners where surfaces cross. When the curved portions 32 are provided respectively to the four supporting portions 21*a*, 21*b*, 21*d* and 21*e*, elasticity is given to the supporting portions 21*a*, 21*b*, 21*d* and 21*e* so as to be capable of supporting the content elastically.

Further, holes 33 as deformation facilitators which facilitate the elastic deformation of the supporting portions 21*a* and 21*d* are provided respectively to the curved portions 32 of the first lower surface supporting portion 21*a* and the first upper surface supporting portion 21*d* which face each other in the up-and-down direction. The holes 33 are lozenged in the example of FIG. 4. Ends of the corners of the supporting portions 21*a* and 21*d* are notched widely so that their rigidity is set to be lower. As a result, suitable elasticity is generated in the supporting portions 21*a* and 21*d*. The shape of the holes 33 is not limited to the example shown in FIG. 4, and thus various shapes such as circular, oval and gourd shapes can be applied. Further, notches such as slits may be provided in a direction parallel with the grain direction S of the corrugated panel in FIG. 4 instead of the holes 33 so that suitable elasticity is generated in the supporting portions by the notches.

In the example shown in FIG. 4, the explanation is given as to the example that the holes 33 are provided only to the curved portions 32 of the first lower surface supporting portion 21*a* and the first upper supporting portion 21*d*. Additionally, the hole 33 can be provided also to the second lower surface supporting portion 21*b* and the second upper surface supporting portion 21*e*. In general, a greater force is applied to the lower surface supporting portions 21*a* and 21*b* which support the content housed and supported in the cushioning support member from below in comparison with the upper surface supporting portions 21*d* and 21*e* which press the content from above. For this reason, the hole or notch is provided only to the upper surface supporting portions 21*d* and 21*e* in the upper position, and the hole or notch does not have to be provided to the lower surface supporting portions 21*a* and 21*b* in the lower position, and vice versa.

Supporting piece portions 25*a* and 25*b* and supporting piece portions 25*c* and 25*d*, which are extended in the same direction, are provided respectively on both the sides of the third side surface portion 22*c* and the fourth side surface portion 22*d* in the grain direction S of the corrugated panel. Namely, the first supporting piece portion 25*a* is connected to one side of the third side surface portion 22*c* in a direction which intersects perpendicularly the third lateral fold line 26*c* via a first longitudinal fold line 35*a*. The second supporting piece portion 25*b* is connected to one side which is counter to the first longitudinal fold line 35*a* via a second longitudinal fold line 35*b*. The third supporting piece portion 25*c* is connected to one side of the fourth side surface portion 22*d* in a direction which intersects perpendicularly the fourth lateral fold line 26*d* via a third longitudinal fold line 35*c*. The fourth supporting piece portion 25*d* is connected to one side which is counter to the third longitudinal fold line 35*c* via a fourth longitudinal fold line 35*d*.

The first through fourth supporting piece portions 25*a* through 25*d* can be bent along three fold lines 36*a*, 36*b* and 36*c* which are parallel with each other, and are provided with four plane portions 37*a*, 37*b*, 37*c* and 37*d*. When the supporting piece portions 25*a* through 25*d* are bent along the three fold lines 36*a* through 36*c* to the same direction, supporting column portions 34*a*, 34*b*, 34*c* and 34*d*, which are surrounded by the four plane portions 37*a* through 37*d* and has square column shape, are constituted. Insertion openings 38 having a predetermined width are provided in halfway portions of the fold lines 36*c* in the outermost positions of the three fold lines 36*a* through 36*c* on the sides of the fourth plane portions 37*d* in the outermost positions. Four engagement portions 39*a*, 39*b*, 39*c* and 39*d*, which fix the first through fourth supporting column portions 34*a* through 34*d* formed into the square column shapes in the predetermined positions, are provided on the third and fourth side surface portions 22*c* and 22*d* correspondingly to the insertion openings 38.

The four engagement portions 39*a* through 39*d* are set in the positions corresponding to the four insertion openings 38, and are formed by cutting the third and fourth side surface portions 22*c* and 22*d* into U shape. Outside portions 37*d* of the supporting column portions 34*a* through 34*d* formed into the square column shapes are overlapped respectively on the inner surfaces of the side surface portions 22*c* and 22*d*. When the four engagement portions 39*a* through 39*d* are inserted respectively into the insertion openings 38 in this state, as shown in FIG. 5, the two supporting column portions 34*a* and 34*b* and the two supporting column portions 34*c* and 34*d* are formed respectively on both the sides of the third and fourth side surface portions 22*c* and 22*d*.

Further, supporting concave portions 40*a*, 40*b*, 40*c* and 40*d*, which support the four corners of the content to be housed and supported in the cushioning support member, are provided respectively to connecting portions between the second plane portions 37*b* and the third plane portions 37*c* of the four supporting column portions 34*a* through 34*d*. The supporting concave portions 40*a* through 40*d* respectively have first through fourth indentation portions 41*a*, 41*b*, 41*c* and 41*d* with intervals according to the thickness of the content to be housed. Both surfaces of the indentation portions 41*a* through 41*d* compose contact portions 41*e* which contact with the corner portions of the content to be housed from sideways so as to support the side surfaces of the content.

The first and second indentation portions 41*a* and 41*b* of the first and second supporting concave portions 40*a* and 40*b* are formed by making two crest-shaped cuts, whose insides have convex shapes in the halfway portion of the center longitudinal fold line 36*a* and enter the second plane portion 37*b* and the third plane portion 37*c* into a predetermined depth. Fold lines 42*a* are provided to both ends of the first and the second indentation portions 41*a* and 41*b*. When the indentation portions 41*a* and 41*b* are bent inward along the fold lines 42*a*, the first and second supporting concave portions 40*a* and 40*b* are formed.

Figure 5:
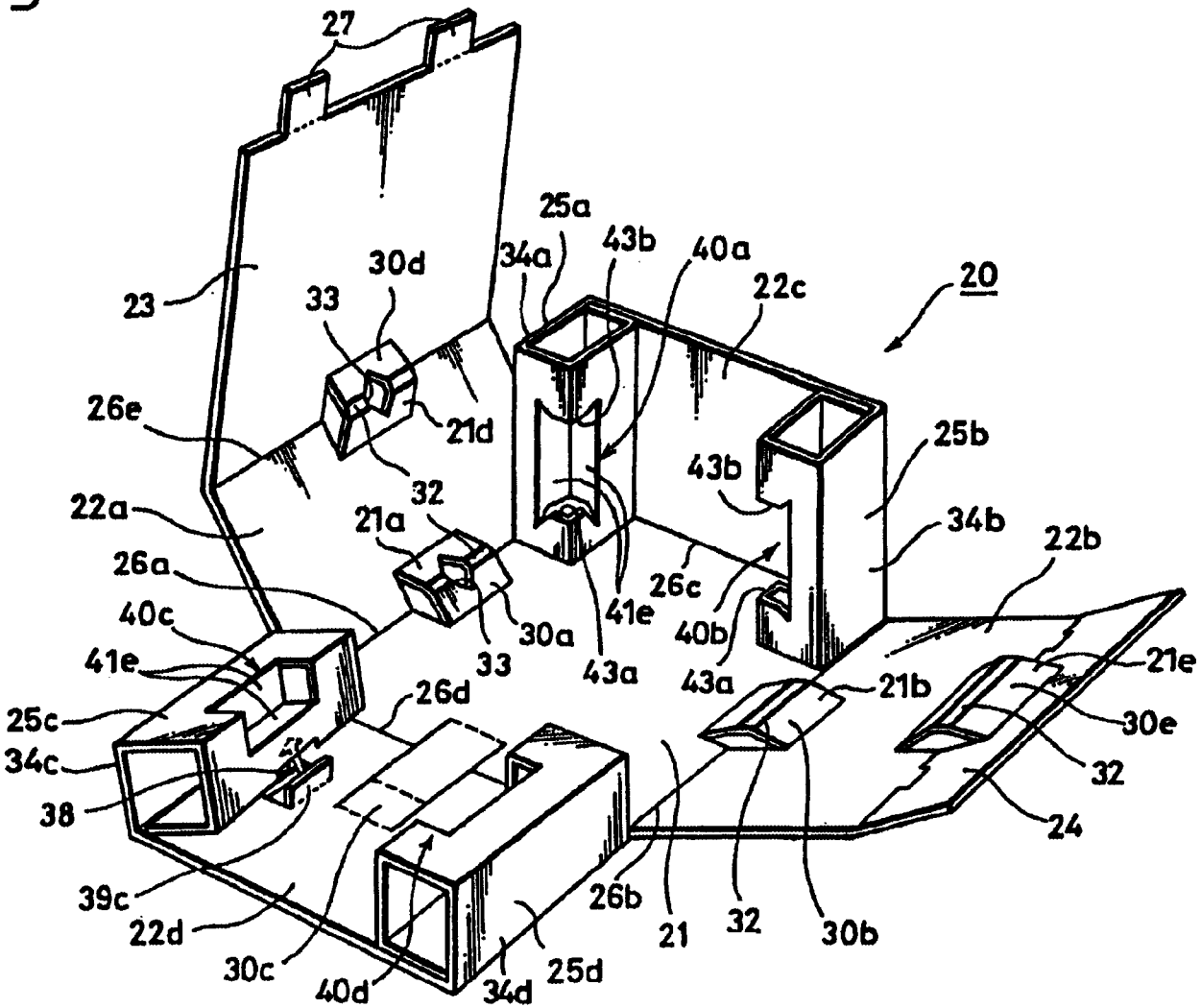
FIG. 5 is a perspective view showing the cushioning support member according to one embodiment of the present invention where supporting column portions or the like are assembled.

Further, as shown in FIG. 5, supporting convex portions 43*a* and 43*b* which support upper and lower surfaces of the corner portions of the content from above and below are formed on both ends left by the two cuts. The supporting convex portions 43*a* and 43*b* are deformed when a predetermined or more external force is applied to the content to be housed and supported from above and below so as to absorb the external force. The supporting convex portion 43*a* is brought into contact with the bottom surface of the corner portions of the content, and the supporting convex portion 43*b* is brought into contact with the upper surface of the corner portions of the content.

The third and fourth indentation portions 41*c* and 41*d* are parallel with each other with a predetermined interval in the halfway portion of the center longitudinal fold line 36*b*, and they are formed by making two cuts which enter the second plane portion 37*b* and the third plane portion 37*c* into a predetermined depth. Fold lines 42*b* are provided on both ends of the third and forth indentation portions 41*c* and 41*d*. When the indentation portions 41*c* and 41*d* are bent inward along the fold lines 42*b*, the third and fourth supporting concave portions 40*c* and 40*d* are formed.

Figure 7:
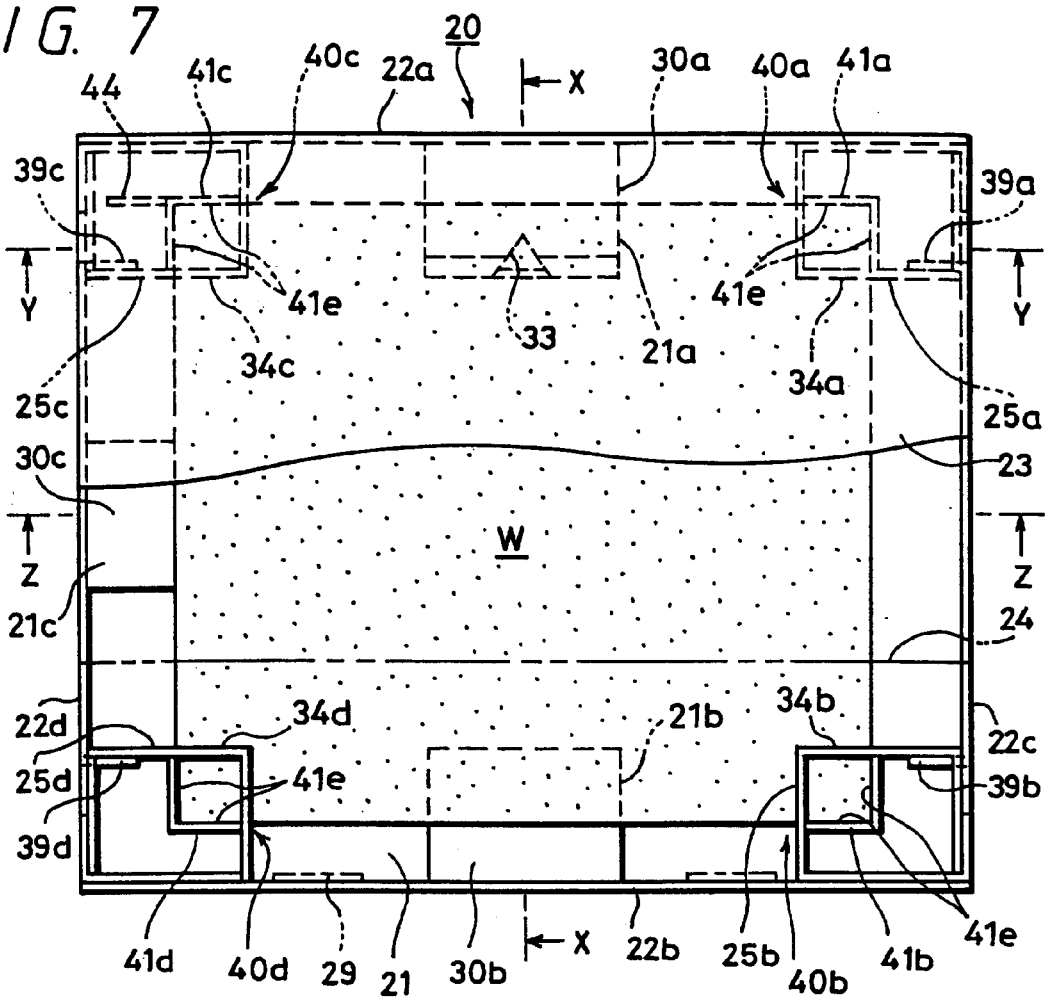
FIG. 7 is a plan view showing the cushioning support member according to one embodiment of the present invention where the content is housed.

The third indentation portion 41*c* of the third and fourth indentation portions 41*c* and 41*d* is provided with a stopper portion 44 which is projected to the side of the third plane portion 37*c*. The stopper portion 44 is formed by providing a portion without a fold line in the halfway portion of the center longitudinal fold line 36*b* and a slit which is connected through both the sides of the portion without a fold line. As shown in FIG. 7, the stopper portion 44 is projected to the side of the fourth side surface portion 22*d* after the assembly. When elastic deformation which causes predetermined fluctuation occurs, the stopper portion 44 abuts against the fourth side surface portion 22*d* so as to restrain the fluctuation.

The fourth indentation portion 41*d* is provided with a relief hole 45 which is opened in a substantially center portion. The relief hole 45 lowers rigidity of the fourth indentation portion 41*d* so as to facilitate the elastic deformation. The stopper portion 44 may be provided to the third indentation portion 41*c* so as to lower the rigidity and facilitate the elastic deformation similarly.

The impact cushioning member composed of the base material 20 having such a structure is assembled in the following manner, for example, so as to be capable of being used for housing and supporting contents W. The base material 20 shown in FIG. 4 is bent along the first through sixth lateral fold lines 26*a* through 26*f* and the first through fourth longitudinal fold lines 35*a* through 35*d* (bent inward) so that a rough hexahedron box is formed.

In this case, the first through fifth foldout portions 30*a* through 30*e* are bent along the fold lines 32*a* to the reverse side (outward), and the foldout portions 30*a*, 30*b*, 30*d* and 30*e* having the curved portions 32 other than the third foldout portion 30*c* are folded along the fold lines provided to the curved portions 32. At this time, in the case where the curved portions 32 are C-shaped curved surfaces, the curved portions 32 are formed into such a shape.

As shown in FIG. 5, the four supporting piece portions 25*a* through 25*d* are assembled into a column shape. At this time, the supporting piece portions 25*a* through 25*d* are bent along the three longitudinal fold lines 36*a* through 36*c* (bent outward), and the square supporting column portions 34*a* through 34*d* which are surrounded by the four plane portions 37*a* through 37*d* are formed. At this time, the indentation portions 41*a* through 41*d* provided to the second and third plane portions 37*b* and 37*c* are bent inward, and the supporting concave portions 40*a* through 40*d* are formed respectively on the supporting column portions 34*a* through 34*d*. The four engagement portions 39*a* through 39*d* provided to the third and fourth side surface portions 22*c* and 22*d* are bent inward so as to be inserted into the corresponding insertion openings 38. As a result, the supporting column portions 34*a* through 34*d* having square column shape are fixed to the right and left sides of the third and fourth side surface portions 22*c* and 22*d*.

Figure 6:
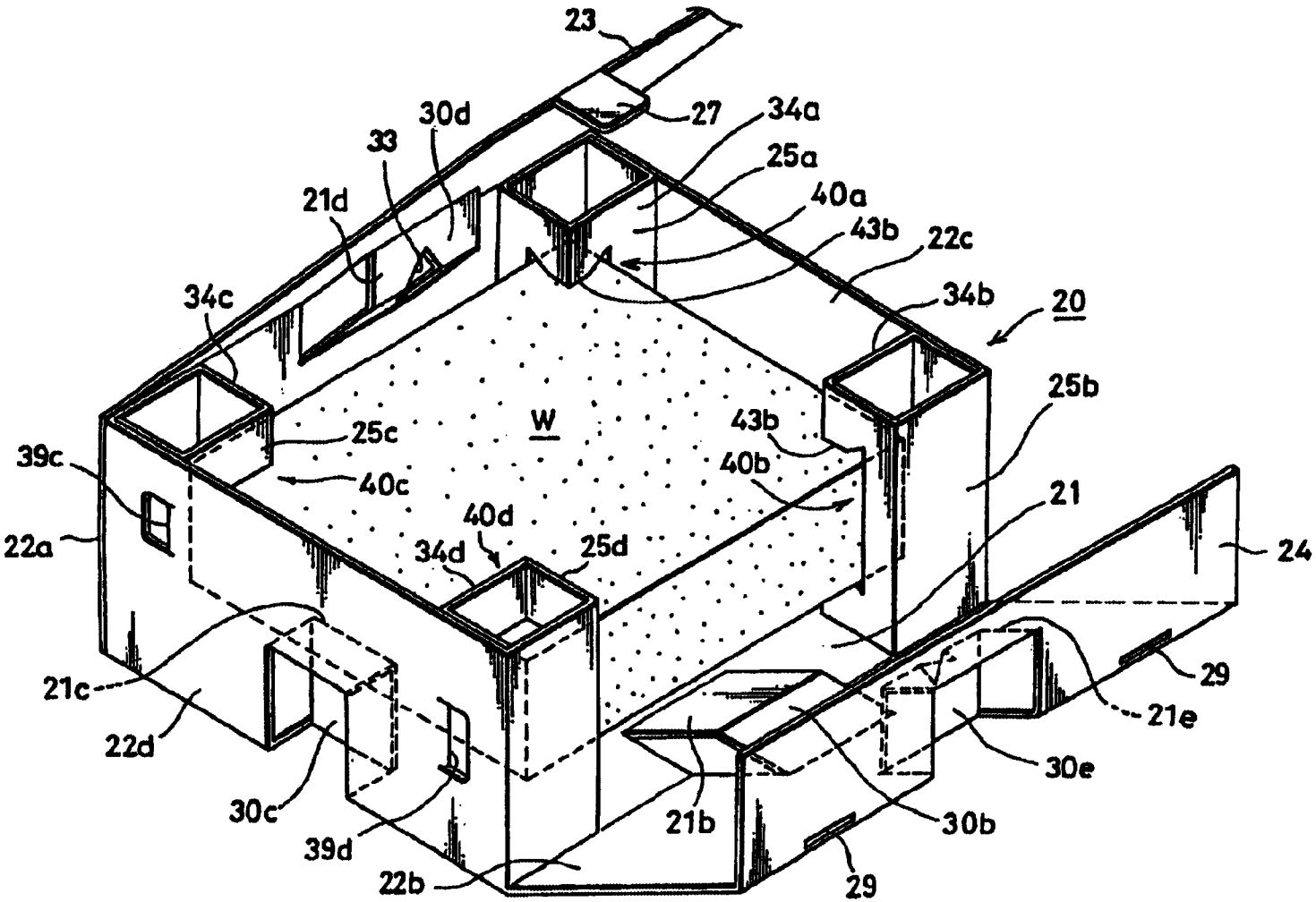
FIG. 6 is a perspective view showing the cushioning support member according to one embodiment of the present invention where contents are housed.

As shown in FIG. 6, the content W to be packaged is housed in the impact cushioning member which undergoes the bending process and is in the half-assembled state. The content W in this example is, for example, a rectangular parallelepiped shaped article composed of a hexahedron having a suitable thickness where its plane shape is rectangular. Examples of such articles are a speaker apparatus such as a small-sized speaker, sound equipment such as an amplifier and electronic equipment such as a tape recorder. In this case, while the third and fourth side surface portions 22*c* and 22*d*, in which the supporting column portions 34*a* and 34*b* and the supporting column portions 34*c* and 34*d* are fixed to their both sides respectively, are being raised, the four supporting concave portions 40*a* through 40*d* are mounted to the four corners of the content W. At this time, the side surface supporting portion 21*c* which is provided to the fourth side surface portion 22*d* is brought into contact with the side surface of one side of the content W from sideways.

Figure 8:
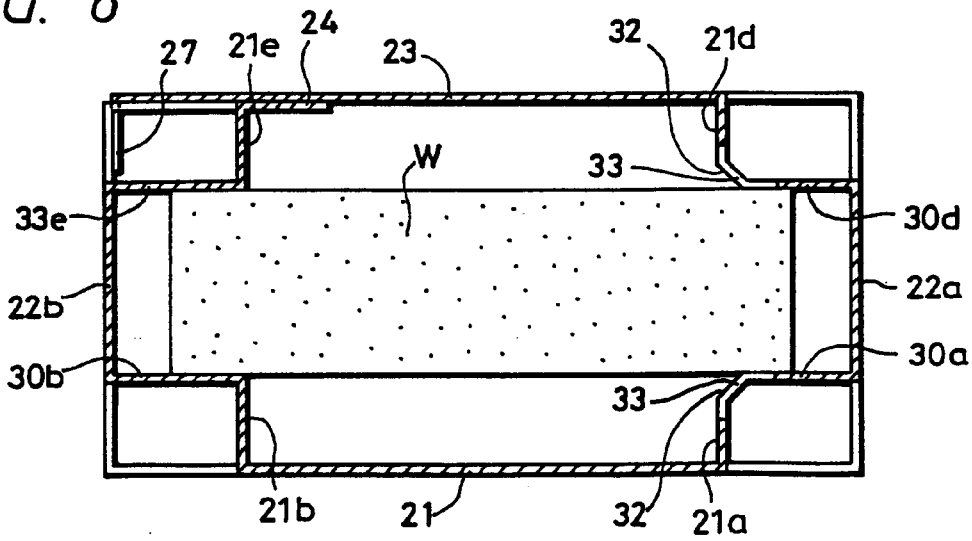
FIG. 8 is a cross section taken along the line 8—8 of FIG. 7.
Figure 9:
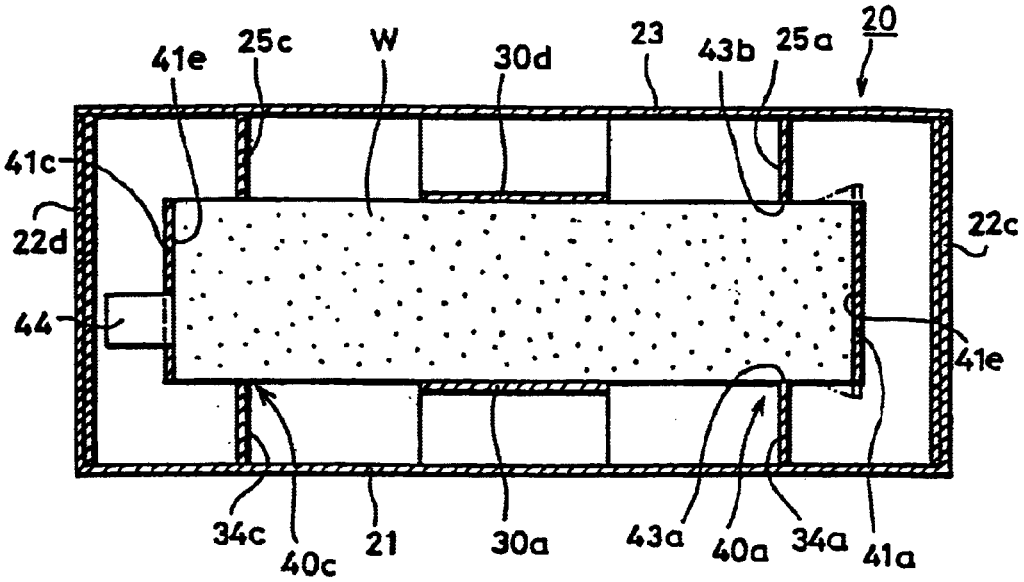
FIG. 9 is a cross section taken along the line 9—9 of FIG. 7.
Figure 10:
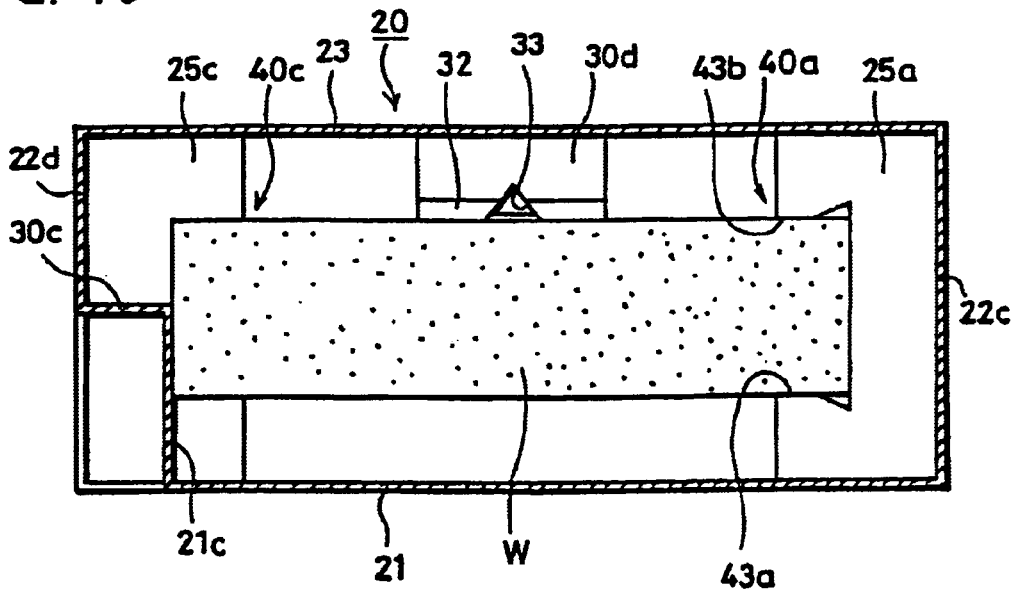
FIG. 10 is a cross section taken along the line 10—10 of FIG. 7.

When the second side surface portion 22*b* is raised, the second lower surface supporting portion 21*b* is raised so as to be brought into contact with the lower surface of one side of the content W. Simultaneously, the second upper surface supporting portion 21*e* is brought above one side of the content W so as to be brought into contact with the upper surface. When the first side surface portion 22*a* is raised, the first lower surface supporting portion 21*a* is raised so as to be brought into contact with the lower surface of one counter side of the content W. Simultaneously, the first upper surface supporting portion 21*d* is brought above the counter one side of the content W so as to be brought into contact with the upper surface. The upper surface portion 23 is overlapped on the overlap portion 24 which covers one portion of the upper surface of the content W. The two flap portions 27 provided at the end of the upper portion 23 are inserted and pushed into the insertion openings 29 provided to the overlap portion 24. As a result, the whole upper surface of the content W is covered with the upper surface portion 23, and all the six surfaces of the content W are surrounded by the six surfaces of the hexahedron with a predetermined gap. As shown in FIGS. 7 and 8, the content W is housed in the packaging container.

The content W housed in such a manner can obtain the following cushioning effect because the cushioning support member has the above-mentioned structure. The content W is supported by the four supporting concave portions 40*a* through 40*d* which are obtained by recessing a portion of the corrugated cardboard. A predetermined gap is set between the bottom surface portion 21 to be an outer wall, the four side surface portions 22*a* through 22*d* and the six surfaces of the upper surface portion 23. Therefore, when an external force is applied to portions other than the corner portions of the six surfaces of the cushioning support member, for example, the external force damages only the bottom surface portion 21, the four side surface portions 22*a* through 22*d* or the upper surface portion 23. In the case where the external force does not reach the content W, the content W is not damaged by the external force so that the content W can be protected.

In this case, when the external force is applied from the bottom surface portion 21 or the upper surface portion 23, the external force acts on the four supporting concave portions 40*a* through 40*d* which support the four corners of the content W. The external force is received by the upper and lower supporting surfaces of the supporting concave portions 40*a* through 40*d*, and an impact force is cushioned by an energy which is consumed when the supporting concave portions 40*a* through 40*d* are deformed. Particularly, since the supporting convex portions 43*a* and 43*b* which support the two corner portions of the content W are formed into a crest shape so as to be deformed more easily than the other portions, the cushioning effect is increased by deformation based on buckling or the like of the supporting convex portions 43*a* and 43*b*. As a result, damage applied to the content W can be reduced.

Further, when the supporting concave portions 40*a* through 40*d* which support the four corners of the content W are damaged, the first and second lower surface supporting portions 21*a* and 21*b* and the first and second upper surface supporting portions 21*d* and 21*e*, which are provided between the adjacent supporting concave portions 40*a* through 40*d*, support upper and lower sides of the content W. As a result, the content W can be protected. Since the supporting portions 21*a*, 21*b*, 21*d* and 21*e* are formed into L shape which facilitate the elastic deformation, the content W can be supported with comparatively soft elasticity. Particularly, the first lower surface supporting portion 21*a* and the first upper surface supporting portion 21*d*, where the bending portion is the curved portion 32, are provided with the hole 33 or the like so that the elastic deformation occur more easily. As a result, the content W can be supported more elastically, and the impact force applied to the content W can be cushioned more effectively. Moreover, the supporting portions 21*a*, 21*b*, 21*d* and 21*e* can support unstableness of the packaging container main body after the supporting column portions 34*a* through 34*d* are buckled.

When an external force is applied from one of the directions of the four side surface portions 22*a* through 22*d*, the external force is applied to the contact portions 41*e* which are formed on counter two sides of the indentation portions 41*a* through 41*d* of the supporting concave portions 40*a* through 40*d*. As a result, the supporting concave portions 40*a* through 40*d* are deformed according to the strength of the external force, and an impact force is cushioned by an energy which is consumed at that time. Moreover, the indentation portions 41*a* through 41*d* are swayed in the lateral direction so as to let the content W escape to the lateral direction. As a result, the content W can be protected. Furthermore, since the content W is supported also from sideways by the side surface supporting portion 21*c*, the impact force is cushioned similarly energy is absorbed when the side surface supporting portion 21*c* is deformed. As a result, the content W can be protected more effectively.

There will be explained below a cushioning test which is carried out by using the cushioning support member. FIGS. 11, 12, 13 and 14 are graphs showing results of the cushioning test. A corrugated cardboard used in this test has a three-layered structure where a flat panel (C liner: 190 g/m$^2$) is laminated on both surfaces of a corrugated panel (semi-chemical pulp SCP: 125 g/m$^2$), and its thickness is 2 mm. The weight of the content W is 1.2 kg, and the cushioning support member which houses the content W is dropped from a height of 70 cm.

Figure 11:
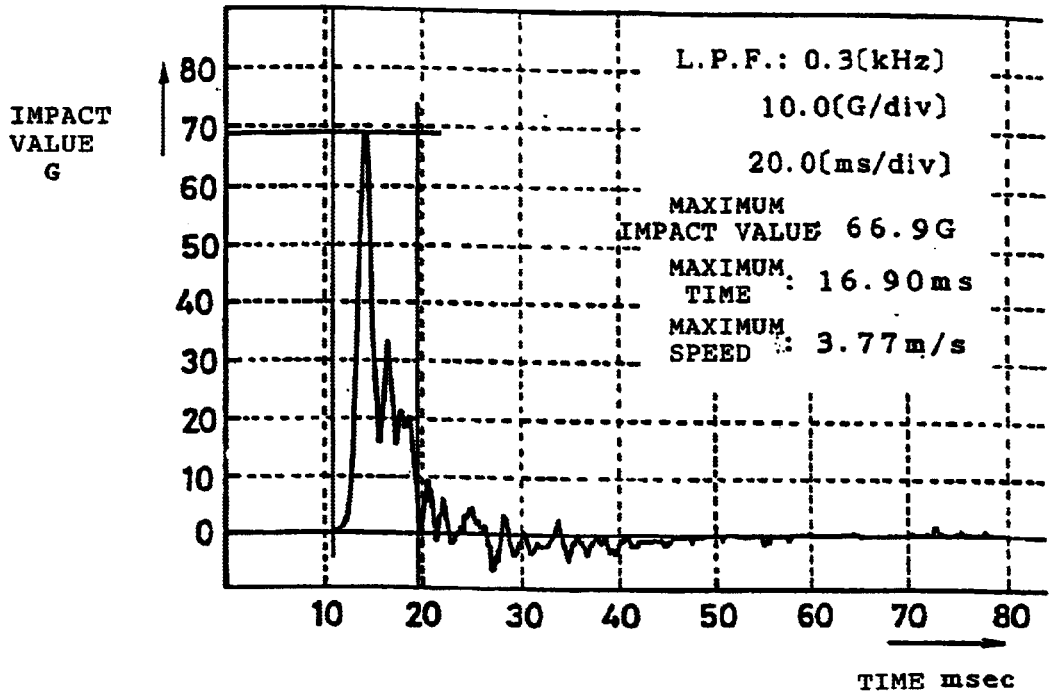
FIG. 11 is a graph showing a result of a cushioning test of the cushioning support member formed by using a base material shown in FIG. 4 in the case where curved portions and holes are provided at the center supporting portion.

As a result, in the base material 20 having the structure of FIG. 4, the result shown in FIG. 11 is obtained. According to this, in the cushioning support member which is composed of the base material 20 where the curved portion 32 is provided to the two lower surface supporting portions 21*a* and 21*b* and the two upper surface supporting portions 21*d* and 21*e* and the hole 33 is provided to two of them, generating time of the maximum impact value is 16.9 msec, and the impact value is 66.9 G (gravitational acceleration). The maximum speed is 3.77 m/s.

Figure 12:
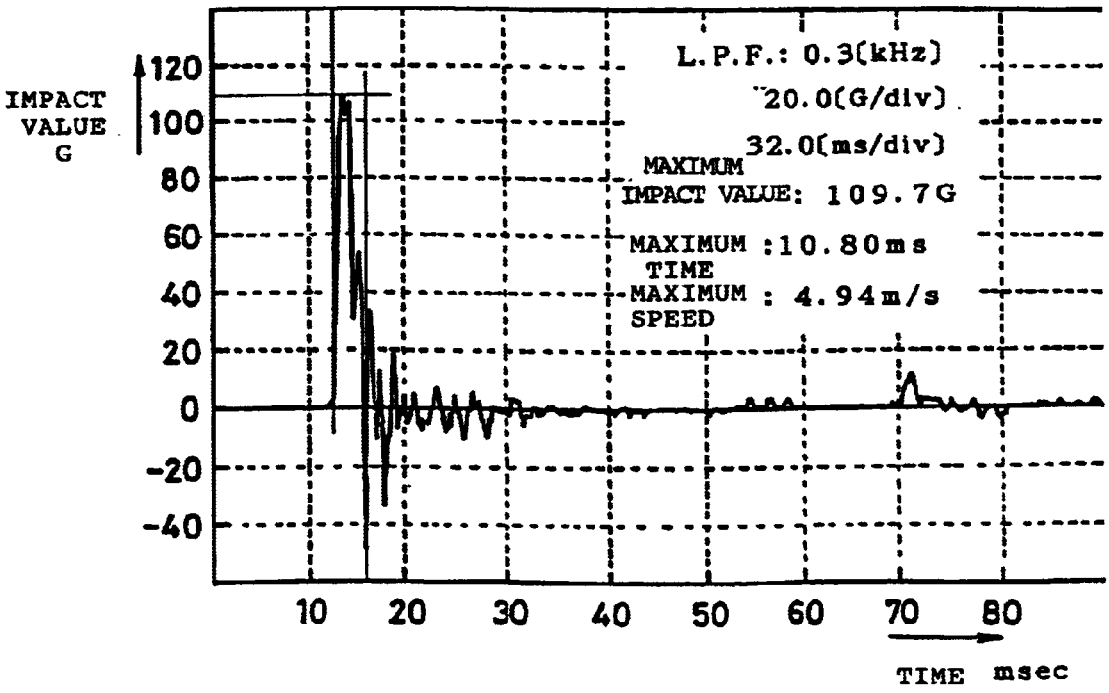
FIG. 12 is a graph showing a result of the cushioning test of the cushioning support member formed by using the base material shown in FIG. 4 in the case where the curved portions and holes are not provided at the center supporting portion.

On the contrary, in the case where only the four supporting portions 21*a*, 21*b*, 21*d* and 21*e* are bent and the curved portion 32 and the hole 33 are not provided to the supporting portions 21*a*, 21*b*, 21*d* and 21*e*, as shown in FIG. 12, the generating time of the maximum impact value is 10.80 msec, and the impact value is 109.7 G (gravitational acceleration). The maximum speed is 4.94 m/s.

Figure 13:
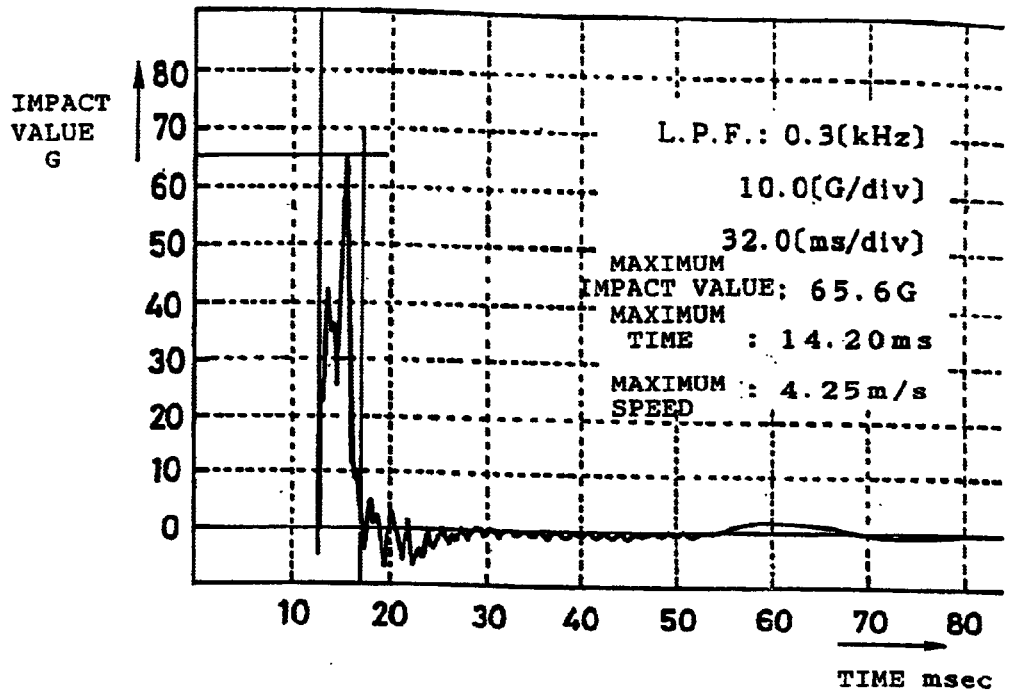
FIG. 13 is a graph showing a result of the cushioning test of the cushioning support member formed by using the base material shown in FIG. 4 in the case where a gap of 25 mm is provided between side surface portions and the content.
Figure 14:
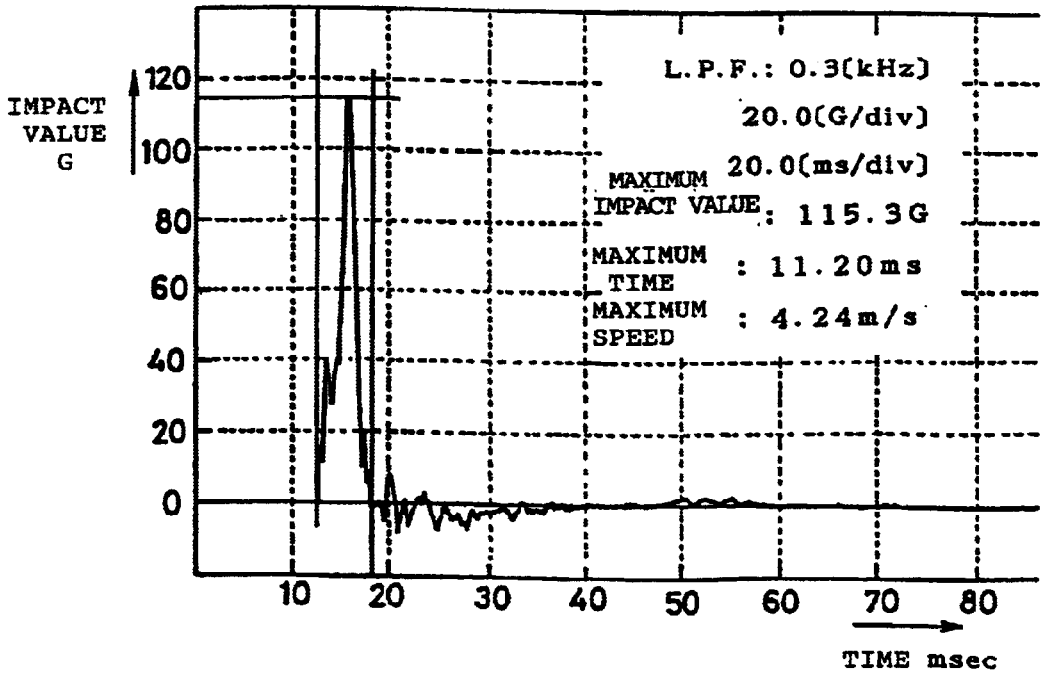
FIG. 14 is a graph showing a result of the cushioning test of the cushioning support member formed by using the base material shown in FIG. 4 in the case where a gap of 15 mm is provided between the side surface portions and the content.

In the case where the gap between the side surface portions 22*a* through 22*d* as the outer walls and the content W is set to 25 mm, the result shown in FIG. 13 is obtained. Namely, the generating time of the maximum impact value is 14.20 msec, and the impact value is 65.6 G, and the maximum speed is 4.25 m/s. On the contrary, in the case where the gap between the side surface portions 22*a* through 22*d* and the content W is set to 15 mm, the result shown in FIG. 14 is obtained. Namely, the generating time of the maximum impact value is 11.20 msec, and the impact value is 115.3 G, and the maximum speed is 4.24 m/s. As a result, it is found that the distance from the outer walls to the content is in inverse proportion to the cushioning result.

According to the cushioning support member of the present invention, the capacity of the box external shape is increased slightly compared with the conventional cushioning material made of styrene foam. However, the container main body can be made by using only one piece of one corrugated cardboard, and thus the cushioning support member of the present invention can simultaneously function as a cushioning material which produces the cushioning effect for protecting the content W from an external force. Further, the base material can be fabricated by only cutting a piece of a corrugated cardboard and a die or the like is not required. For this reason, the base material can be fabricated at a low price, and the process after use is simple, and there is no fear of harm to the environment.

The present invention is not limited to the above-mentioned example. The example referred to the case in which the present invention is applied to the cushioning support material for an electronic equipment such as a tape recorder. However, the present invention can be used for housing other contents such as a camera and its interchangeable lenses. Further, the arrangements of the upper surface portion 23 and the side surface portions 22*a* through 22*d* and the like, their size, shape and the like are not limited to the example. Various arrangements, sizes, shapes and the like can be applied.

In addition, the example referred to the case that the supporting piece portions 25*a* through 25*d* are provided respectively to both the sides of the two side surface portions 22*c* and 22*d* and the content W is supported by the four supporting column portions 34*a* through 34*d*, but a number of the supporting piece portions may be at least three. The content W may be supported by the three supporting column portions formed by these three supporting piece portions, and the supporting column portions can be provided in five or more places. Further, the shape of the content W is not limited to the rectangular parallelepiped in the example, and the shape can be applied to solids whose plane shape is triangular, pentagonal, hexagonal and the other polygonal.

The present invention can be modified variously without departure from the gist.

INDUSTRIAL APPLICABILITY

According to the cushioning support member of the present invention, the bottom surface portion and a plurality of side surface portions and a plurality of supporting piece portions are provided, and they are formed by one corrugated cardboard. Moreover, a plurality of supporting column portions which support corner portions of a cubic content to be housed and supported and a plurality of contact portions are formed. As a result, a predetermined gap is provided between the bottom surface portion, side surface portions and the upper surface portion so that the content can be held securely. When an external force is applied to the bottom surface portion, the side surface portions or the upper surface portions, the external force can be absorbed by deformation of the supporting column portions and elastic deformation of the contact portions and the like. For this reason, even if an accident such as dropping occurs, an impact force which is applied to the housed and supported content is cushioned so that the content can be protected effectively.

In addition, according to the fabricating method of the cushioning support member of the present invention, the base material can be fabricated easily by only cutting a piece of corrugated cardboard, and a die or the like is not required. As a result, the cushioning support member can be fabricated at a low price, and the process after use is easy. As a result, the cushioning support member where there is no fear of destroying environment can be provided.

What is claimed is:

1. A cushioning support member comprising:

a polygonal bottom surface portion;

a plurality of side surface portions formed continuously on respective sides of said bottom surface portion; and a plurality of supporting piece portions which are formed on at least two side surface portions of said plurality of side surface portions, wherein said bottom surface portion, said plurality of side surface portions and said plurality of supporting piece portions are formed of a single piece of corrugated cardboard, and a plurality of supporting column portions are formed by bending sections of said side surface portions into respective cylindrical shapes so as to support corners of a cubic content, and a plurality of contact portions which contact side surfaces of said cubic content are formed, and connecting portions between said plurality of side surface portions and said bottom surface portion are bent so as to support said cubic content, wherein a supporting portion, which supports said cubic content by contact with a lower surface of said cubic content, is formed upon side surface portions of said plurality of side surface portions not having a supporting piece portion.

2. The cushioning support member according to claim 1, wherein said plurality of supporting column portions have concave supporting portions which support the corner portions of said cubic content, and said contact portions are formed along at least two opposing sides of said concave supporting portions.

3. The cushioning support member according to claim 2, wherein said plurality of supporting column portions are constituted such that at least one convex supporting portion is formed on said concave supporting portions.

4. The cushioning support member according to claim 3, wherein said convex supporting portions are formed by upper and lower sides of said concave supporting portions.

5. The cushioning support member according to claim 2, wherein at least one cut is made on said supporting piece portions and said supporting piece portions are bent so that said concave supporting portions and said contact portions are formed.

6. The cushioning support member according to claim 1, wherein an additional supporting portion which supports said cubic content by contact with an upper surface side of said cubic content is formed upon said side surface portions of said plurality of side surface portions not having a supporting piece portion.

7. The cushioning support member according to claim 6, wherein a deformation facilitating portion, which facilitates elastic deformation when an external force is applied to said supporting portions, is formed on at least one supporting portion of said plurality of supporting portions and said additional supporting portions.

8. The cushioning support member according to claim 7, wherein said supporting portions and said additional supporting portions are formed by making at least one cut on said side surface portions of said plurality of side surface portions not having a supporting piece portion and bending said side surface portions.

9. The cushioning support member according to claim 7, wherein said deformation facilitating portion is a hole.

10. The cushioning support member according to claim 7, wherein said deformation facilitating portion is a notch.

11. The cushioning support member according to claim 7, wherein a side surface supporting portion which supports said cubic content by contact with the side surfaces of said cubic content is formed on at least one side surface portion of said plurality of side surface portions.

12. The cushioning support member according to claim 11, wherein said side surface supporting portion is formed by making at least one cut on said at least one side surface portion and bending said at least one side surface portion.

* * * * *